US011618179B2

(12) United States Patent
Jakob

(10) Patent No.: US 11,618,179 B2
(45) Date of Patent: Apr. 4, 2023

(54) DEVICE FOR INSERTING A FIRST RAM OR A SECOND RAM IN AN ALTERNATING MANNER

(71) Applicant: BOXPLAN GMBH & CO. KG, Steisslingen (DE)

(72) Inventor: Tobias Jakob, Radolfzell (DE)

(73) Assignee: BOXPLAN GMBH & CO.KG, Steisslingen (DE)

( * ) Notice: Subject to any disclaimer, the term of this patent is extended or adjusted under 35 U.S.C. 154(b) by 94 days.

(21) Appl. No.: 16/475,346

(22) PCT Filed: Jan. 16, 2018

(86) PCT No.: PCT/EP2018/050918
§ 371 (c)(1),
(2) Date: Jul. 1, 2019

(87) PCT Pub. No.: WO2018/134163
PCT Pub. Date: Jul. 26, 2018

(65) Prior Publication Data

US 2019/0337182 A1 Nov. 7, 2019

(30) Foreign Application Priority Data

Jan. 18, 2017 (DE) ..... 10 2017 100 957.4

(51) Int. Cl.
*B26D 7/18* (2006.01)

(52) U.S. Cl.
CPC ..... *B26D 7/1818* (2013.01)

(58) Field of Classification Search
CPC ..... B26D 7/1818; B26D 2007/1872
See application file for complete search history.

(56) References Cited

U.S. PATENT DOCUMENTS 4,139,941 A * 2/1979 Meacham ..... B26B 27/00 30/123
4,932,819 A * 6/1990 Almeras ..... F16B 5/00 411/386

(Continued)

FOREIGN PATENT DOCUMENTS

CN 202070894 U 12/2011
CN 103372613 A 10/2013

(Continued)

OTHER PUBLICATIONS

Machine Translation of DE 102008062114 (Year: 2010).*
International Search Report issued in related PCT/EP2018/050918 dated Apr. 26, 2018 (4 pages).

*Primary Examiner* — Moshe Wilensky
*Assistant Examiner* — Kyle A Cook
(74) *Attorney, Agent, or Firm* — Bookoff McAndrews PLLC

(57) ABSTRACT

The invention relates to a device for inserting a first ram (1) or a second ram (2) in an alternating manner into a ram feeder (3) of a device for inserting stripping pins and stripping claws into a stripping tool, wherein the first ram (1) and the second ram (2) are mounted on a retaining plate (6) so as to be moveable in a first movement direction (4), wherein the ram feeder (3) can be moved in a second movement direction (5), and wherein the first movement direction (4) is orthogonal to the second movement direction (5).

16 Claims, 2 Drawing Sheets

(56) References Cited

U.S. PATENT DOCUMENTS

| | | | | |
|---|---|---|---|---|
| 5,049,122 | A | 9/1991 | Marschke | |
| 5,291,652 | A | 3/1994 | Vossen et al. | |
| 5,568,675 | A * | 10/1996 | Asami | F16B 19/1081 24/297 |
| 5,844,142 | A * | 12/1998 | Blanch | A61B 17/06004 73/827 |
| 2002/0113403 | A1* | 8/2002 | Chen | B62K 19/36 280/288.4 |
| 2007/0172327 | A1* | 7/2007 | Hansen | F16B 19/1081 411/41 |
| 2008/0226420 | A1* | 9/2008 | Huang | F16B 5/0283 411/352 |
| 2009/0179422 | A1* | 7/2009 | Werth | F16L 33/2071 285/243 |
| 2012/0141201 | A1* | 6/2012 | Anderson, III | B60B 27/0021 403/374.4 |
| 2013/0263686 | A1* | 10/2013 | Osawa | B62D 1/184 74/495 |
| 2014/0311311 | A1 | 10/2014 | Jakob | |
| 2015/0191982 | A1* | 7/2015 | Steine | E21B 19/24 166/241.6 |
| 2018/0133878 | A1* | 5/2018 | Neubauer | B25D 1/00 |

FOREIGN PATENT DOCUMENTS

| | | | |
|---|---|---|---|
| DE | 4103339 | A1 | 9/1992 |
| DE | 29707792 | A1 | 7/1997 |
| DE | 100 23 896 | A1 | 11/2001 |
| DE | 20 2008 012789 | U1 | 3/2010 |
| DE | 10 2008 062114 | A1 | 6/2010 |
| DE | 10 2012 103858 | A1 | 6/2013 |
| WO | 2017/194659 | A1 | 11/2017 |

* cited by examiner

DEVICE FOR INSERTING A FIRST RAM OR A SECOND RAM IN AN ALTERNATING MANNER

CROSS-REFERENCE TO RELATED APPLICATION(S)

This application is a National Stage under 35 U.S.C. § 371 of International Application No. PCT/EP2018/050918, filed on Jan. 16, 2018, which claims priority to German Application No. 10 2017 100 957.4, filed Jan. 18, 2017, the contents of all of which are incorporated by reference in their entirety.

TECHNICAL FIELD

The invention relates to a device for inserting a first ram or a second ram in an alternating manner according to the preamble of claim 1.

BACKGROUND ART

Various automation techniques for manufacturing a stripping tool are known and used in the background art.

In this connection reference is made to U.S. Pat. No. 5,049,122 which discloses an automation for stripping pins.

Further, reference is made to DE 297077921, which also discloses an automated method for manufacturing a stripping tool, wherein stripping pins are also used in an automated manner here.

In the same manner, reference is made to U.S. Pat. No. 5,291,652 A and DE 4103339 A1.

However, none of the citations describe an automated manufacturing method of a stripping tool, wherein not only stripping pins but also flat stripping claws are to be used.

Object of the Invention

The object of the present invention is to overcome the disadvantages of the background art. In particular, a device is to be provided which enables an automated manufacture of a stripping tool, in which, in addition to the stripping pins, stripping claws can be set automatically and mechanically. This is to take place in such a manner that various rams can additionally be set easily and quickly with one and the same ram feeder in a space-saving manner.

Solution of the Object

The features according to claim 1 lead to the solution of the object. Advantageous embodiments are described in the dependent claims.

A device according to the invention serves for alternately inserting a first ram or a second ram into a ram feeder. Two different rams are of advantage here, as the two rams can have different properties, in order to, for example, insert different stripping claws into the stripping tool. A corresponding quick change between the first ram and the second ram is therefore essential.

The first ram and the second ram are thereby arranged movably on a retaining plate in a first movement direction. The ram feeder is movable in a second movement direction, wherein the first movement direction is orthogonal to the second movement direction. The first movement direction and the second movement direction are also reversible. This means that each movement direction can also be reversed according to the requirements of the user.

The first ram comprises a first stripping claw head and the second ram comprises a second stripping claw head.

The first ram has a first spring and the second ram has a second spring. The two springs can serve, for example, for resetting the two rams.

The first ram and the second ram are arranged parallel to each other on a carriage. A reception is arranged on the carriage, wherein the first ram and the second ram are held in the reception. The carriage is thereby moved over two rails, which are arranged on the retaining plate. The carriage, for example, thereby has grooves, which are in operative connection with the rails and permit a defined movement of the carriage.

The ram feeder has a guide sleeve. The guide sleeve thereby serves for receiving, retaining and introducing the stripping claw into a stripping tool. For this, the guide sleeve has a stripping claw receiving slot.

Further, the carriage can be mobilized in the first movement direction by a drive. The ram feeder can also be moved in the second movement direction by a further drive. After the ram feeder has released the first stripping claw head by moving in the second movement direction, the carriage can for example be moved in the first movement direction, until the second stripping claw head is positioned in such a manner that, when moving the ram feeder back against the second movement direction, the second stripping claw head moves into the ram feeder, in order to drive a stripping claw possibly retained in the stripping claw receiving slot, for example into a wooden board for manufacturing a stripping tool. This process for the automated setting of stripping claws can be repeated any number of times.

The first movement direction and the second movement direction can respectively be moved reversibly.

DESCRIPTION OF THE FIGURES

Further advantages, features and details of the invention will become apparent from the following description of preferred exemplary embodiments and by means of the drawings; these show in.

EXEMPLARY EMBODIMENT

Figure 1:
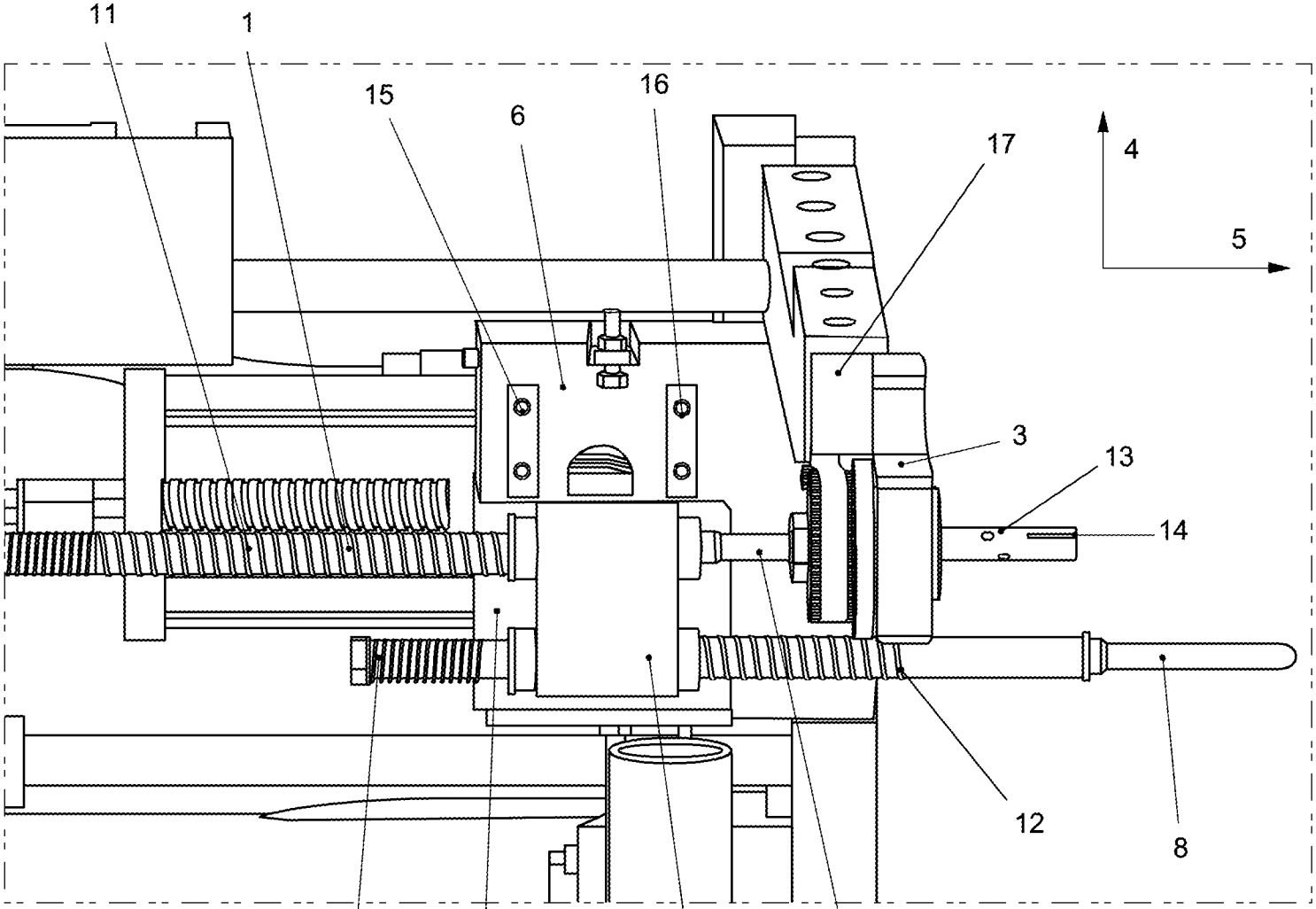
FIG. 1 a device according to the invention in a first position.

A device for alternately inserting a first ram 1 or a second ram 2 into a ram feeder 3 is shown in FIG. 1.

The first ram 1 and the second ram 2 are thereby arranged movably on a retaining plate 6 in a first movement direction 4.

For this, the retaining plate 6 has a first rail 15 and a second rail 16. On the rails 15, 16, a carriage 9 is movable, wherein the carriage 9 is present in a reception 10.

The first ram 1 and the second ram 2 are arranged parallel to each other on the carriage 9. The rams 1,2 are thereby arranged in the reception 10.

The first ram 1 comprises a first stripping claw head 7. The second ram 2 comprises a second stripping claw head 8. The first ram 1 has a first spring 11. The second ram 2 has a second spring 12. The reception 10 also serves as a stop for the springs 11, 12.

The springs 11, 12 are elastic springs, which are respectively arranged around the two rams. The spring 11 is arranged around the ram 1. The spring 12 is arranged around the ram 2.

Figure 2:
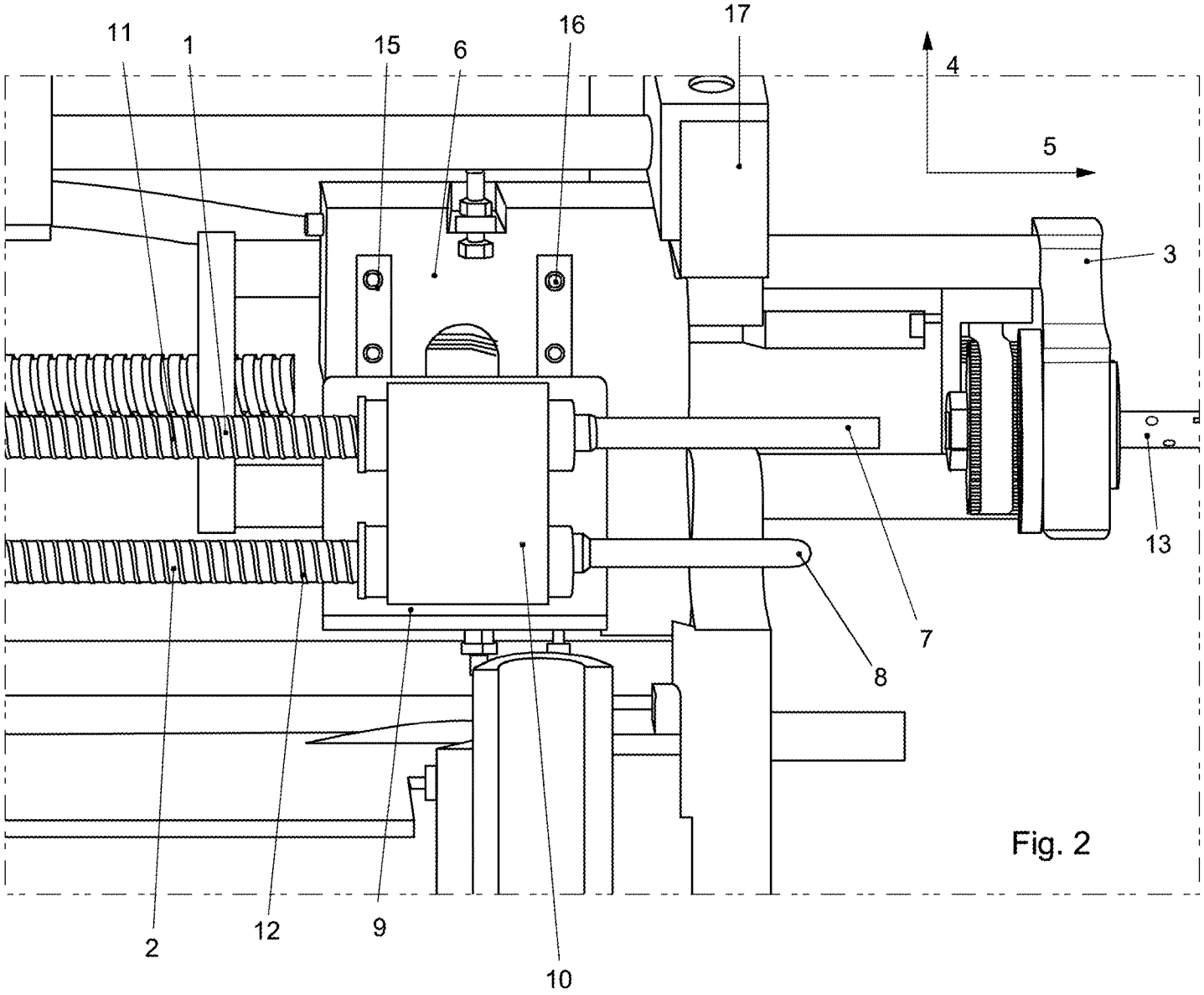
FIG. 2 the device according to the invention of FIG. 1 in a second position.

The retaining plate 6 is arranged on a function plate 17. The function plate 17 in turn serves as a stop for the ram feeder 3. FIG. 1 shows how the ram feeder 3 is moved to the function plate 17. FIG. 2 shows how the ram feeder 3 is moved away from the function plate 17 in the second movement direction 5.

The ram feeder 3 is movable in a second movement direction 5, wherein the first movement direction 4 is orthogonal to the second movement direction 5.

The ram feeder 3 has a guide sleeve 13. The guide sleeve 13 thereby has a stripping claw receiving slot 14. The stripping claw receiving slot 14 serves for the automated reception of stripping claws. For this, the ram feeder 3 is moved in the second movement direction 5. A stripping claw is thereby inserted into the stripping claw receiving slot 14.

After the ram feeder 3 is moved back against the second movement direction 5 in the direction of the function plate 17, the first stripping claw head 7 or the second stripping claw head 8 moves in the guide sleeve 13. If the second stripping claw head 8 is to be used, the carriage 9 is moved in the first movement direction 4 on the rails 15, 16.

The carriage 9 comprises a drive not shown in detail, which is movable in the first movement direction 4. Further, the ram feeder 3 can be moved in the second movement direction 5 by a further drive, also not shown.

| List of reference numerals | |
|---|---|
| 1 | First ram |
| 2 | Second ram |
| 3 | Ram loader |
| 4 | First movement direction |
| 5 | Second movement direction |
| 6 | Retaining plate |
| 7 | First stripping claw head |
| 8 | Second stripping claw head |
| 9 | Carriage |
| 10 | Reception |
| 11 | First spring |
| 12 | Second spring |
| 13 | Guide sleeve |
| 14 | Stripping claw receiving slot |
| 15 | First rail |
| 16 | Second rail |
| 17 | Function plate |
| 18 | |
| 19 | |
| 20 | |
| 21 | |
| 22 | |
| 23 | |
| 24 | |
| 25 | |
| 26 | |
| 27 | |
| 28 | |
| 29 | |
| 30 | |
| 31 | |
| 32 | |
| 33 | |
| 34 | |
| 35 | |
| 36 | |
| 37 | |
| 38 | |
| 39 | |
| 40 | |
| 41 | |
| 42 | |
| 43 | |
| 44 | |
| 45 | |
| 46 | |

-continued

| List of reference numerals |
|---|
| 47 |
| 48 |
| 49 |
| 50 |
| 51 |
| 52 |
| 53 |
| 54 |
| 55 |
| 56 |
| 57 |
| 58 |
| 59 |
| 60 |
| 61 |
| 62 |
| 63 |
| 64 |
| 65 |
| 66 |

The invention claimed is:

1. A device for alternately inserting a first ram or a second ram into a ram feeder including a guide sleeve, the guide sleeve having a first end configured to alternately receive the first ram or the second ram and a second end including a receiving slot extending from the second end into the guide sleeve and through an outer circumference of the guide sleeve, wherein the first ram and the second ram are arranged movably on a retaining plate in a first movement direction, wherein the ram feeder is movable in a second movement direction orthogonal to the first movement direction, wherein a longitudinal axis of the guide sleeve extends in the second movement direction from a surface of the ram feeder, and the surface of the ram feeder is orthogonal to the second movement direction and facing away from the retaining plate, wherein the longitudinal axis of the guide sleeve remains parallel to the second movement direction during an entire time period from a reception of a first stripping claw into the receiving slot, through a reception of the first ram or the second ram into the first end to remove the first stripping claw from the receiving slot, and through a reception of a second stripping claw into the receiving slot, and wherein the device includes a drive configured to automatically insert the first stripping claw into the receiving slot by moving the ram feeder in the second movement direction and away from the first ram and the second ram.

2. The device of claim 1, wherein the receiving slot is configured to receive a flat stripping claw in a direction opposite to a direction of the insertion of the first ram or the second ram into the guide sleeve.

3. The device of claim 2, wherein the receiving slot comprises a stripping claw stop.

4. The device of claim 1, wherein the first ram comprises a first stripping claw head, and the second ram comprises a second stripping claw head different from the first stripping claw head.

5. The device of claim 4, wherein the first ram has a first spring, and the second ram has a second spring.

6. The device of claim 5, wherein the first ram is arranged parallel to the second ram on a carriage.

7. The device of claim 6, wherein the carriage can be moved in the first movement direction by a further drive.

8. The device of claim 6, wherein a reception is arranged on the carriage, and wherein the first ram and the second ram are held in the reception.

9. The device according to claim 8, wherein the reception serves as a stop for the first spring and the second spring.

10. An apparatus comprising:

a retaining plate;

a carriage connected to the retaining plate and movable relative to the retaining plate along a first axis;

a first ram inserted into the carriage and movable in the carriage along a second axis perpendicular to the first axis, the first ram including a first stripping head;

a second ram inserted into the carriage and movable in the carriage along a third axis parallel to the second axis, the second ram including a second stripping head;

a ram feeder including a guide sleeve extending from a surface of the ram feeder facing away from the carriage, the guide sleeve having a first end configured to alternately receive the first ram or the second ram and a second end including a receiving slot extending from the second end into the guide sleeve and through an outer circumference of the guide sleeve; and a drive configured to automatically insert a stripping claw into the receiving slot by moving the ram feeder relative to the retaining plate along a fourth axis parallel to the third axis and away from the first ram and the second ram, wherein the carriage is moveable to align the first ram or the second ram with the guide sleeve, and wherein the ram feeder is movable relative to the retaining plate along the fourth axis parallel to the third axis to receive the stripping claw into the receiving slot of the guide sleeve in a movement away from the carriage and to receive the first ram or the second ram into the guide sleeve in a movement toward the carriage.

11. The apparatus of claim 10, wherein the first stripping head is different from the second stripping head.

12. The apparatus of claim 11, wherein the first stripping head is for a stripping pin, and the second stripping head is for a stripping claw.

13. An apparatus comprising:

a retaining plate;

a carriage connected to the retaining plate and movable relative to the retaining plate along a first axis;

a first ram inserted into the carriage and movable in the carriage along a second axis perpendicular to the first axis, the first ram having a first length and including a first stripping head;

a second ram inserted into the carriage and movable in the carriage along a third axis parallel to the second axis, the second ram having a second length and including a second stripping head;

a ram feeder including a guide sleeve extending from a surface of the ram feeder facing away from the carriage, the guide sleeve having a first end configured to receive either the first ram or the second ram and a second end including a receiving slot extending from the second end into the guide sleeve and through an outer circumference of the guide sleeve; and a drive configured to automatically insert a first stripping claw into the receiving slot by moving the ram feeder along the second axis in a direction away from the first ram and the second ram, wherein the first stripping head is shaped to release the first stripping claw from the receiving slot in a direction away from the ram feeder, and wherein the second stripping head is shaped differently from the first stripping head to drive a second stripping claw from the receiving slot to manufacture a tool.

14. The apparatus of claim 13, wherein the first stripping head has a flat end, and the second stripping head has a rounded end.

15. The apparatus of claim 14, wherein the first length is greater than the second length.

16. A method of operating the apparatus of claim 10, the method comprising:

moving the ram feeder away from the carriage to remove the first ram from the guide sleeve and the ram feeder;

moving the carriage to align the second ram with the guide sleeve; and moving the ram feeder toward the carriage to insert the second ram into the guide sleeve and the ram feeder.

* * * * *